US007578006B2

(12) United States Patent
Garneau

(10) Patent No.: US 7,578,006 B2
(45) **Date of Patent: *Aug. 25, 2009**

(54) HIGH BREATHABILITY CYCLING HAND GLOVE

(75) Inventor: Louis Garneau, St-Augustin-de-Desmaures (CA)

(73) Assignee: Louis Garneau Sports Inc. (CA)

( * ) Notice: Subject to any disclaimer, the term of this patent is extended or adjusted under 35 U.S.C. 154(b) by 0 days.

This patent is subject to a terminal disclaimer.

(21) Appl. No.: 11/282,099

(22) Filed: Nov. 18, 2005

(65) Prior Publication Data

US 2007/0113317 A1 May 24, 2007

(51) Int. Cl.
*A41D 19/00* (2006.01)

(52) U.S. Cl. ..... 2/161.1; 2/159; 2/161.3; 2/161.6; 2/161.8

(58) Field of Classification Search ..... 2/159, 2/161.1, 161.3, 161.6, 161.8
See application file for complete search history.

(56) References Cited

U.S. PATENT DOCUMENTS 4,458,429 A * 7/1984 Schmid ..... 36/3 A
4,747,163 A 5/1988 Dzierson
5,640,712 A * 6/1997 Hansen et al. ..... 2/20
6,618,860 B1 9/2003 Sullivan et al.
6,845,519 B2 1/2005 Garneau
D506,593 S * 6/2005 Garneau ..... D2/738
7,254,840 B2 * 8/2007 Hammons et al. ..... 2/16
2003/0188373 A1 * 10/2003 Garneau ..... 2/161.1
2004/0148679 A1 * 8/2004 Garneau ..... 2/159
2004/0176714 A1 * 9/2004 Darcey ..... 602/21
2005/0210570 A1 * 9/2005 Garneau ..... 2/466
2006/0195968 A1 * 9/2006 Powell et al. ..... 2/161.1

OTHER PUBLICATIONS

Pearl Izumi Fall/Winter 2006 catalogue (4 pages) and cover pp. (2).
Pearl Izumi Summer 2006 catalogue (2 pages) and cover p. (1).

* cited by examiner

*Primary Examiner*—Gary L. Welch
*Assistant Examiner*—Alissa J Tompkins
(74) *Attorney, Agent, or Firm*—Cantor Colburn LLP

(57) ABSTRACT

A cycling hand glove includes a main glove element having a palm surface; and a palm pad provided on the palm surface and having at least one aeration aperture therein exposing at least one of the main glove element and the hand of the cyclist inserted into the hand glove.

27 Claims, 6 Drawing Sheets

HIGH BREATHABILITY CYCLING HAND GLOVE

BACKGROUND OF THE INVENTION

1) Field of the Invention

The invention relates to an athletic hand glove and, more particularly, to a cycling hand glove having palm-located pads or cushions for use over a bicycle handlebar. The invention also relates to a method for manufacturing cycling hand gloves including cushioning pads in the palm area.

2) Description of the Prior Art

When riding a bicycle, a cyclist usually grasps the handlebar with his hands. It is critical that the cyclist's hands have a good command and control of the handlebars, as they provided inter alia for directional control of the bicycle, center of gravity stability control of the cyclist and bicycle assembly, proper positioning and access for actuating the wheel braking system if need arises.

Cyclists tend to use hand gloves for improved comfort. Some of these hand gloves include pads inside the palm of the glove for comfort cushioning between the palm of the hand and the handlebar. Moreover, they provide protection to the hands of the cyclist in the case of a fall, and they minimize abrasion to the hands of the cyclist.

As the cyclist pedals to maintain the bicycle in motion in upright dynamic stability condition over ground, corresponding muscular exercise is generated, and thus bodily heat and perspiration levels increase. In particular, perspiration levels tend to increase substantially at the ends of the limbs, i.e. at the feet and hands.

Therefore, some cycling gloves include perforated mesh material allowing free escape and release of moisture from the hand palm perspiration. For example, U.S. Pat. No. 6,845,519 describes a hand glove for use over a bicycle handlebar by a cyclist. The glove includes a perforated palm area and a few cushioning pads surrounding the palm area. The cushioning pads are closedly spaced from one another so as to define at least a few air channels formed radially between the cushioning pads. The bodily moisture escaping from the perforated palm area escape through the air channels, even when a bicycle handlebar is grasped.

However, the cushioning pads are relative thick members and do not allow the escape of moisture located between the cyclist hand and the cushioning pads, especially when the gloves engage the handlebar. Therefore, moisture build-up between the cyclist hand and the cushioning pads tends to be most acute. There is thus a need for a hand glove combining both qualities, i.e. the comfort provided by the cushioning pads and an adequate ventilation between the cyclist's hand and the exterior of the hand glove.

SUMMARY OF THE INVENTION

It is an aspect of the invention to improve comfort of cyclists wearing hand gloves with cushioning pads by reducing moisture build-up between the cyclist hand and the cushioning pads.

One aspect of the invention provides a cycling hand glove which comprises: a main glove element having a palm surface; and a palm pad provided on the palm surface and having at least one aeration aperture therein exposing at least one of the main glove element and the hand of the cyclist inserted into the hand glove.

Another aspect of the invention provides an athletic glove which comprises a main body; and a cushioning pad having an inner face mounted to the main body, an exposed outer face opposed to the inner face, and an aeration aperture therein with an inner end opening on the inner face and an outer end opening on the outer face.

A further aspect of the invention provides a method to manufacture an athletic glove. The method comprises: mounting a cushioning pad having a cushioning section over a main body of the athletic glove; and providing at least one perforation through the cushioning pad so as to expose the main body of the athletic glove when the cushioning pad is mounted thereto.

According to a general aspect, there is provided a cycling hand glove comprising: a main glove element having a palm surface; and a palm pad provided on the palm surface, extending above a section of the main glove element, and having an outer layer and a padding layer extending between the outer layer and the main glove element, the palm pad having at least one aeration aperture therein exposing at least one of the main glove element and the hand of the cyclist inserted into the hand glove, a recessed border surrounding the at least one aeration aperture, the padding layer being compressed in the recessed border, and a cushioning section contiguous to the recessed border.

According to another general aspect, there is provided a method to manufacture an athletic glove. The method comprises: mounting a cushioning pad having a cushioning section over a main body of the athletic glove, the cushioning pad including an outer layer and padding layer extending between the outer layer and the main body, the padding layer having a thickness t1 in the cushioning section; thermoforming at least one recess section within the cushioning pad by applying heat and line pressure to the cushioning pad, the padding layer of the cushioning pad having a thickness t2 in the at least one recess section thinner than the thickness t1 of the cushioning pad in the cushioning section; and providing at least one perforation through the at least one recess section of the cushioning pad so as to expose the main body of the athletic glove when the cushioning pad is mounted thereto.

According to a further general aspect, there is provided an athletic glove comprising a glove body having a palm portion comprising an upper section and a lower section, the upper section being adjacent to fingers and the lower section being adjacent to a wrist when the glove is worn by a user, the palm portion having a mesh material, and a cushion pad mounted to the mesh material of the palm portion, the cushion pad having an outer layer and a cushion extending between the outer layer and the mesh material, the cushion pad having at least one recess section surrounded by a cushioning section of the cushion pad and including the cushion in a compressed state, and an aeration aperture defined through the at least one recess section and exposing the mesh material.

According to a farther general aspect, there is provided an athletic glove comprising: a main glove element having a palm surface including an upper section, a lower section, and a central palm section extending between the lower and the upper sections, the upper section being adjacent to fingers and the lower section being adjacent to a wrist when the glove is worn by a user; a lower section cushion pad mounted to the main glove element in the lower section; and an upper section cushion pad mounted to the main glove element in the upper section, the central palm section being cushion pad free, the lower and upper section cushion pads having an outer layer and a padding layer extending between the outer layer and the main glove element, at least one of the lower and upper section cushion pads having at least one recess section surrounded by a cushioning section of the cushion pad, and an aeration aperture defined through the at least one recess section and exposing at least one of the main glove element and a hand inserted into the glove.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION OF THE PREFERRED EMBODIMENT

Figure 1:
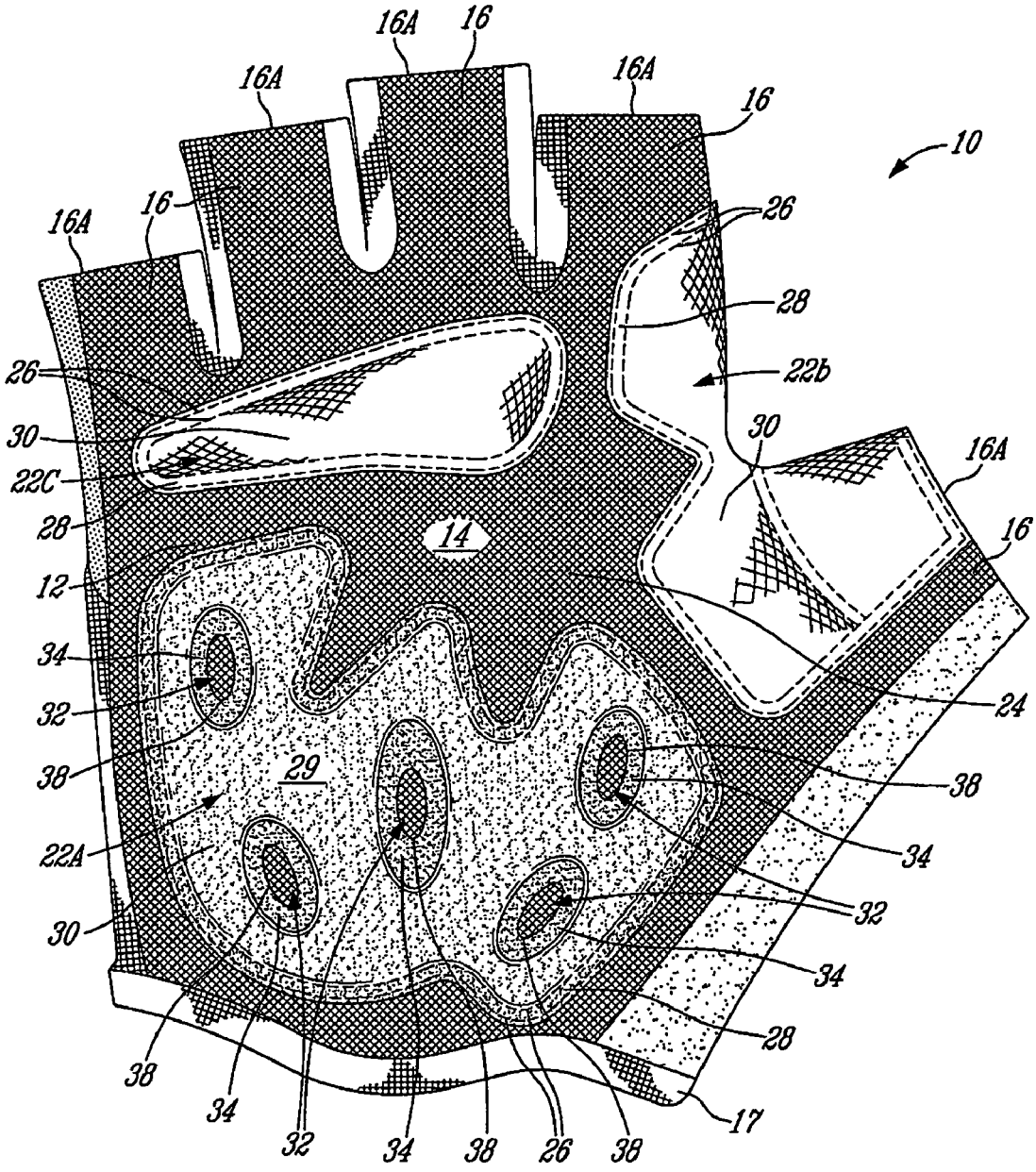
FIG. 1 is a top plan view of a cycling hand glove including a cushioning pad with aeration apertures therein in accordance with an embodiment of the invention.

Referring to the drawings and, more particularly, referring to FIG. 1, there is shown an embodiment of an athletic glove 10 for both male and female uses, for example, cycling gloves that improve the comfort and the protection of the hands of a male/female riding a bicycle.

The hand glove 10 shown in FIG. 1 is a right-hand cycling glove, adapted to engage the handlebar B (FIG. 4) of a bicycle. The palm surface 12 of the glove 10 is formed of a main element 14, preferably mesh material, i.e. a synthetic or fabric-like perforate flexible material whose perforation units are each of a size and shape enabling free bodily heat release and free humidity escape therethrough from the hand.

The five finger portions 16 of the hand glove 10 are cut at the second phalanx, as is known in the art, so that the finger tips (not shown) be free of the main element 14 and be able to freely engage the bicycle handlebar B. The finger portions 16 of the hand glove 10 can be lined with the synthetic material LYCRA™. A hook and loop fastener band assembly (VELCRO™) can releasably close in a loop the wrist end of the hand glove 10 around the wrist of the cyclist. Overlock stitches can form the annular ends of each open finger end portion mouth 16A.

The palm surface 12 of the hand glove 10 includes three individual cushioning pads 22*a*, 22*b*, 22*c*, or palm pads, which are strategically-located. The cushioning pads 22 are mounted to the main element 14 of glove 10, peripherally to a central section 24 so that an irregularly shaped star shaped section is formed in the palm portion 12 of the hand glove 10. As a person skilled in the art will appreciate the pattern of the cushioning pads 22 in the palm 12 of the hand glove 10 can differ from the one shown in FIG. 1. Preferably, the cushioning pads 22 are strategically located on the palm surface 12 of a user's hand to facilitate the bending of the glove 10, as the user's hand grasps an object such as the handlebar B of a bicycle. Preferably, the two upper cushioning pads 22*b*, 22*c* are smaller in size than the lower cushioning pad 22*a* for minimizing flexing discomfort when the glove 10 is inserted into a cyclist's hand.

In the embodiment of FIG. 1, the cushioning pads 22*a*, 22*b*, 22*c* are mounted to the main element 14 with stitching lines 26 provided at the perimeter 28 of the pads 22*a*, 22*b*, 22*c*. However, a person skilled in the art will appreciate that the cushioning pads 22 can be mounted to the main element 14 with any appropriate technique.

The cushioning pads 22 have a cushioning section 30, thicker than the main element 14. The cushioning pad 22*a* includes a plurality of elliptical aeration openings 32, or aeration apertures, surrounded by the cushioning section 30. The aeration apertures 32 extend entirely though the cushioning pad 22*a* and expose a section of the main element 14. The aeration apertures 32 provide ventilation to the cyclist's hand during use of the hand glove 10. Such ventilation cools the cyclist's hand while using the hand glove 10 and enables moisture evacuation to keep the cyclist's hand dry. Additionally, the aeration apertures 32 provide increased flexibility of the hand glove 10, thus enhancing comfort to the cyclist.

Aperture border sections 34, or recesses, surround the aeration apertures 32. The aperture border sections 34 are contiguous to the cushioning section 30 and are thinner than the latter. The aeration apertures 32 are resultantly seated at a substantially planar base of the cushioning pad 22*a*, such that the aeration apertures 32 are surrounded by a portion of the reduced thickness part of the cushioning pad 22*a* which forms the aperture border sections 34. The aeration apertures 32 are inset into the cushioning pad 22*a*. Each aeration opening 32 is defined by an inner edge 38 of the cushioning pad 22*a*. The aeration openings 32 provide a ventilation channel between the palm section of a hand, covered by the cushioning pad 22*a*, and the exterior of the hand glove 10.

According to one embodiment, the aeration apertures 32 are larger than the unit perforation in the mesh material of the main element 14 of the glove 10. The aeration apertures 32 could, for instance, be circular or ovoidal in shape as shown in FIG. 1. The aeration apertures 32 allow free heat release and moisture escape from the palm area 12 of the glove 10, under the cushioning pad 22*a*. The warm air and the moisture generated by the user's hand under the cushioning pad 22*a* can escape freely through the perforations of the mesh material 14 and the aeration apertures 32 provided inside the cushioning pad 22*a*. Moreover, fresh air intake can reach the user's hand under the cushioning pad 22*a* through the aeration apertures 32 and the perforations of the mesh material 14. Therefore, the comfort of the user is improved without reducing the protection offered by the gloves 10.

The aeration apertures 32 can be disposed regularly across the surface of the cushioning pad 22*a*. Alternatively, the aeration apertures 32 can be disposed randomly or in predetermined concentrated groupings across the cushioning pad 22*a*.

The perimeter 28 of the cushioning pad 22*a* is thinner than the cushioning section 30 and blends smoothly into the fabric material that forms the palm 12 of the athletic glove 10. Similarly, the aperture border sections 34 of the cushioning pad 22*a* are thinner than the cushioning section 30. In the embodiment shown, for the perimeter section 28 and the aperture border sections 34, an outer layer 29 of the cushioning pad 22*a* is laminated directly over the main element 14. For the cushioning section 30, a relatively thick intermediate padding layer 50 (FIG. 4) is inserted between the outer layer 29 and the main element 14. The construction of the cushioning pad 22*a* will be described in more details below in reference to FIG. 4.

Figure 2:
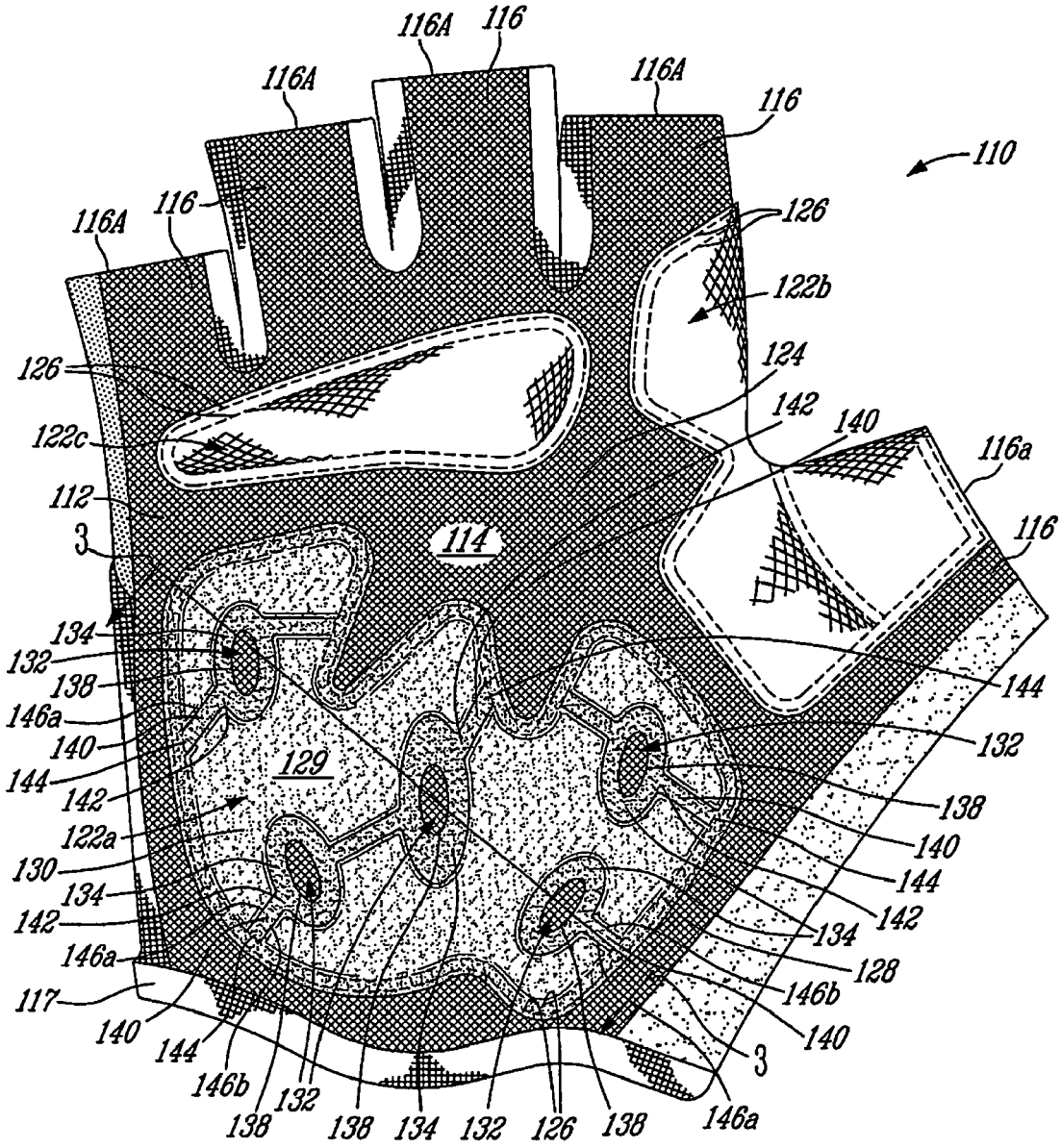
FIG. 2 is a top plan view of a cycling hand glove in accordance with another embodiment wherein a cushioning pad includes moisture escape channels for fluid communication between the aeration apertures in the cushioning pad and the exterior of the cushioning pad.

Referring to FIG. 2, it will be seen another embodiment of the glove 10 wherein the features are numbered with reference numerals in the 100 series which correspond to the reference numerals of the previous embodiment.

The glove 110 shown in FIG. 2 includes three spaced-apart cushioning pads 122*a*, 122*b*, 122*c* located on the palm side 112, each having a perimeter section 128 and a cushioning section 130 thicker than the surrounding perimeter 128. As the cushioning pad 22*a*, the cushioning pad 122*a* includes border sections 134, or recesses, thinner than the cushioning section 130, and having inner edges 138 defining individual and spaced apart central aeration apertures 132 exposing the main element 114 of the hand glove 110. The aeration apertures 132 provide moisture escape outlets and/or fresh air intake ports for the cyclist's palm area located under the cushioning pad 122*a*.

The cushioning pad 122*a* is also provided with a plurality of moisture escape channels 140, each moisture escape channel 140 opening on a first end 142 on the border section 134 and on a second end 144 either on the perimeter section 128 or on another border section 134. The moisture escape channels 140 provide a fluid communication between the central aeration apertures 132 and the exterior of the cushioning pad 122*a*. The moisture escape channels 140, or recessed inset, facilitate the fluid exchanges between the user's palm and the exterior of the hand glove 110.

The distance between the opposite facing edges 146*a*, 146*b* defining the moisture escape channels 140 should be wide enough to provide an adequate ventilation between the aeration apertures 132 and the exterior of the glove 110, but sufficiently close so as to prevent the bicycle handlebar B to undesirably come into sealing contact with the aeration apertures 132.

Figure 3:
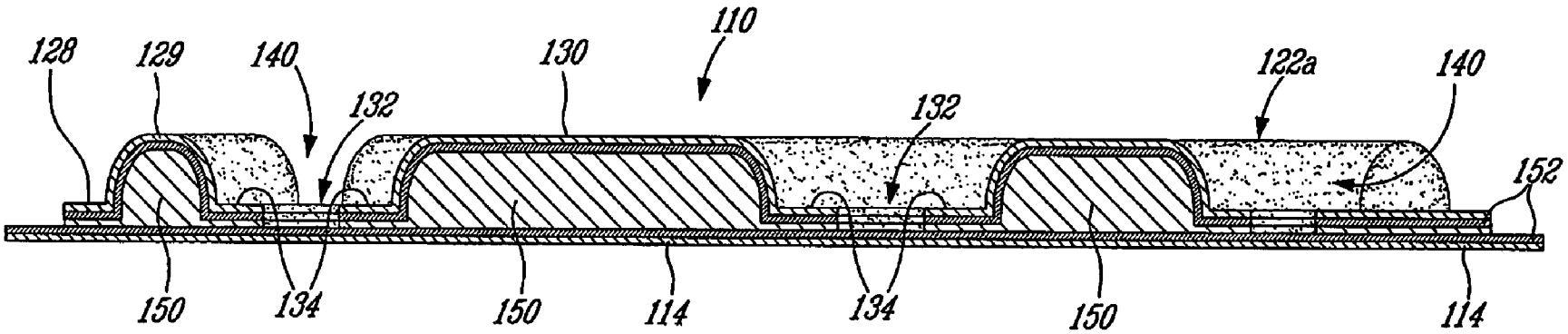
FIG. 3 is a cross-sectional view taken along line 3-3 of FIG. 2 showing the cushioning pad, the aeration apertures, and the moisture escape channels.

Referring to FIG. 3, it will be seen that in the embodiment shown in FIG. 2, the cushioning pads 122 include an intermediate padding layer 150 inserted between two polymer films 152 and an outer layer 129 covering the assembly of the padding layer 150 and the polymer films 152.

For manufacturing the hand glove 110 including the aeration apertures 132 within the cushioning pad 122*a*, the padding layer and polymer film assembly is first cut into the predetermined shape of the cushioning pad 122*a*. This can be carried out by die-cutting or any other appropriate technique known to those skilled in the art. The outer layer 129 is cut into the predetermined shape of the cushioning pad 122*a* independently of the padding layer and polymer film assembly. However, a person skilled in the art will appreciate the outer layer 129 and the padding layer and polymer film assembly can be cut into the predetermined cushioning pad shape in a single step. As for the padding layer and polymer film assembly, the outer layer 129 can be cut by die-cutting or any other appropriate technique known to those skilled in the art.

Then, the outer layer 129 and padding layer and polymer film assembly are juxtaposed and the perimeter section 128, the border section 134, and the moisture escape channel 140 are thermoformed. The perimeter section 128, the border section 134, and the moisture escape channel 140 are formed by permanently compressing the cushioning pad 122*a* to obtain the desired reduced thickness thereof. The compression is achieved by heat treatment or, more preferably, by a high frequency fusion treatment. The aeration apertures 132 are then cut or, more preferably, die punched through the reduced thickness portion of the cushioning pad 22*a*, 122*a* at the aperture border sections 34, 134.

The aperture border sections 134 are preferably formed on an upper surface of the hand glove 10. The aeration apertures 132, as described, are inset into theses aperture border sections 134. The inset configuration of the aeration apertures 132 is advantageous in several respects. Firstly, the permanently compressed nature of the aperture border sections 134 expedite formation of the aeration apertures 132 through the cushioning pads 122*a*. That is, the aeration apertures 132 can be easily and consistently punched through the compressed aperture border sections 134 without encountering difficulties inherent in punching or cutting the non-compressed, fully formed, thick padded material prevalent at the cushioning section 130. Secondly, the compressed aperture border sections 134 resists tearing proximate the aeration apertures 132 during formation thereof and during subsequent use of the hand glove 10 by the cyclist.

Additionally, the inset feature of the aeration apertures 132 serves to prevent blockage thereof during use of the hand glove 10. As noted above, a particular aperture border section 134 is larger in area than the corresponding aeration aperture 132. Thus, due to the larger size of the aperture border section 134, the cyclist's body may contact a portion of one of the aperture border section 134 while another portion of the same aperture border section 134 remains open, thus providing a direct pathway to the corresponding aeration aperture 132 for ventilation. Even if, during use of the hand glove 10, the handlebar B fully contacts and entirely covers an aeration border section 134, the corresponding aeration aperture 132 can remain open and capable of allowing ventilation.

Therefore, the perimeter section 128, the border section 134, and the moisture escape channel 140 are continuous heat/pressure-formed depression lines and the thickness of the cushioning pad 122*a* is materially reduced along its edges. Thus, the edges of each cushioning pad 122*a* blends smoothly into the fabric material that forms the palm 112 of the athletic glove 110. The thickness of the perimeter section 128, the border section 134, and the moisture escape channel 140 is reduced relatively to the cushioning section 130 of the cushioning pad 122*a*, which is not thermoformed.

Then, the cushioning pad 122*a* is disposed over the palm section 112 of the main element 114 and stitching lines 126 are performed in the perimeter section 128 to attach the cushioning pad 122*a* to the main element 114. A person skilled in the art will appreciate that these manufacturing steps can be carried out in a different order or differently. For example, the polymer films 152 can be cut independently of the padding layer 150. The cushioning pad 122*a* can be attached to the main element 114 before thermoforming the border section 134, the perimeter section 128 and the moisture escape channel 140. Stitches lines can be performed in the border section 134 and the moisture escape channel 140 for attaching these sections 134, 140 to the main element 114.

In another embodiment, the outer layer 129, the padding layer 150 and the polymer films 152 can be juxtaposed, then the perimeter section 128, the border section 134, and the moisture escape channel 140, if any, can be formed by permanently compressing the juxtaposed layers to obtain the desired reduced thickness. Then, the cushioning pad 122*a* and the aeration apertures 132 can be simultaneously punched through the compressed perimeter 128 and border sections 128, 134. Finally, the cushioning pad 122*a* can be mounted to the main element 114.

The cushioning pads 122*b*, 122*c* are manufactured by a similar technique than the one described above for the cushioning pad 122*a*, except that no border section 134 and/or moisture escape channel 140 is thermo-formed in the cushioning pads 122*b*, 122*c*. The cushioning pads 122*b*, 122*c* also include a relatively thick intermediate padding layer 50 inserted between the main element 114 and the outer layer 129, or surface layer. The cushioning pads 122*b*, 122*c* are mounted to the main element 114 with stitching lines 126 in the perimeter section 28, 128.

The outer layer 29, 129 can be a leather lining, for example, Amara leather. However, a person skilled in the art will appreciate that it can be made of other materials such as, without being limitative, the same material than for the main element 14, 114.

The padding layer 50 (FIG. 4), 150 may include a partly compressible material for added comfort, for example, open cell and/or closed cell foams. A person skilled in the art will appreciate that the use of both existing equivalent foam members and after developed equivalent foam members. Examples of existing and equivalent foam members include, but are not limited to, gel-filled foam members, liquid-filled foam members, air-filled foam members, memory foam members, bio-gel members and combinations thereof.

While various individual layers of the hand glove 10 are herein specified, this description in only exemplary and is not intended to limit or otherwise narrow the invention. The hand glove 10 can include any number of layers in any potential combination thereof as desired for achieving the comfort properties and padding provided by the hand glove. Further, it shall be understood that the layers composing the hand glove may individually be formed of a uniform, monolithic material construction or, alternatively, such layers can themselves be composed of a plurality of material layers. Thus when describing and reciting 'a layer' of the hand glove herein, any of these constructions are contemplated, as well as combinations and variations thereof.

According to an embodiment of the glove, the thickness of the cushioning pads 122 can vary for example between 1 and 13 millimeters (mm), but preferably in the range of approximately 2 to 8 mm, and still more preferably between 3 to 6.5 mm.

Even if in the embodiments described above, the cushioning pads 22, 122 include a relatively thick and intermediate padding layer 50 (FIG. 4), 150, a person skilled in the art will appreciate that the cushioning pads 22, 122 can or cannot include the padding layer 50, 150. For example, the cushioning pads 22, 122 can include only a relatively thick reinforced fabric (not shown) whose function it is to reinforce a selected area of the palm 12, 112 of the glove 10, 110 or a substantially incompressible soft material, for example, a bundle of fabric. Depending on the material used for the cushioning pads 22, 122, it is possible that they include solely one layer, for example, a relatively thick reinforced fabric.

In the embodiment shown in FIGS. 2 and 3, the polymer films 152 used are polyester films. However, a person skilled in the art will appreciate that other polymers can be used. It is also possible to remove the polymer film 152 from the cushioning pads 122. In that embodiment, the padding layer 150 will be inserted directly between the main element 114 and the outer layer 129.

In accordance with an embodiment of the glove, there is a relatively important difference between the thickness of the hand glove 10, 110 in the aeration apertures 32, 132 and in the cushioning section 30, 130 of the cushioning pads 22, 122, especially when it includes a padding layer 50, 150. In the embodiment shown, the main element 14, 114 is directly exposed in the aeration apertures 32, 132. No other material layer is laminated on the main element 14, 114 in the aeration apertures. However, a person skilled in the art will appreciate that another material than the material of the main element 14, 114 can be exposed or that the user's palm can be directly exposed in the aeration apertures 32, 132. Moreover, the main element 14, 114 can include several materials connected to one another. Therefore, the material of the main element 14, 114 exposed in the aeration apertures 32, 132 can differ from the one exposed in the central palm area 24, 124.

Figure 4:
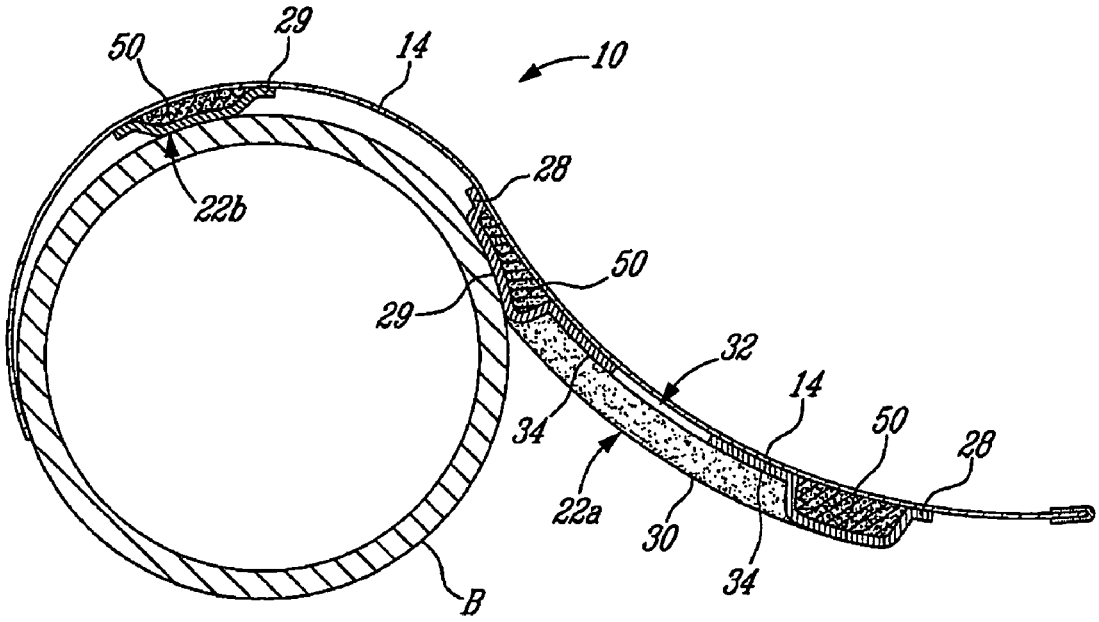
FIG. 4 is a sectional view of the cycling hand glove shown in FIG. 1 engaged with a portion of a bicycle handlebar.

The cushioning section 30, 130 of the cushioning pads 22*a*, 122*a* usually includes the relatively thick intermediate padding layer 50, 150 inserted between the main element 14, 114 and the outer layer 29, 129, or surface layer, covering the padding layer 50, 150. The air and moisture circulation is easier and faster through the aeration apertures 32, 132 than through the cushioning section 30, 130. As shown in FIG. 4, the combination of the cushioning section 30, 130 and the aeration apertures 32, 132 in the cushioning pads 22*a*, 122*a* provides both comfort cushioning between the hand palm and the handlebar B and release of moisture from the hand palm perspiration, even under the cushioning pads 22*a*, 122*a*.

FIG. 4 suggests that although the cushioning pad 22*a* can be partly compressed against the handlebar B by the cyclist's hand grasping the handlebar B with glove 10 (110, . . . ), there remain the air apertures 32 that provide ventilation between the exterior of the glove 10 and the user's hand under the cushioning pad 22*a*. In FIG. 4, the configuration of the cushioning pad 22*a* differs from the one described above for the cushioning pad 122*a*. In the perimeter section 28 and the border section 34, the outer layer 34 extends directly over the main element 14. The padding layer 50 is disposed only in the cushioning section 30 of the cushioning pad 22*a*, between the main element 14 and the outer layer 29. No polymer films 152 are inserted between the main element 14 and the padding layer 50 and between the padding layer 50 and the outer layer 29.

Even if, in the embodiments shown in FIGS. 1 to 4, the cushioning pads 22, 122 are mounted to the main element 14, 114 using stitching lines, a person skilled in the art will appreciate that that the cushioning pads 22, 122 can be secured or welded to the main element 14, 114 of the glove 10, 110 by the operation of a heat-activated adhesive, as permanent depressed lines are formed around each of the cushioning pads 22, 122 by the application of heat and line pressure. The selective application of heat and line pressure to the cushioning pads 22, 122 can operate to adhesively attach the cushioning pads 22, 122 to the main element 14, 114 of an athletic glove 10, 110. The border section 34, 134 and/or the moisture escape channels 140 can also be attached to the main element 14, 114 using a heat-activated adhesive.

For example, the cushioning pads 22, 122 can be formed from three flexible layers, sheets or pieces (not shown), i.e. a relatively thin and lower heat-sensitive adhesive layer, film or membrane that can be formed of a thermoplastic polymer such as polyurethane (PU) or of a synthetic thermoplastic polymer such as polyvinyl chloride (PVC), a relatively thick and middle layer that can be formed of a heat-meltable or heat-deformable synthetic foam, and a relatively thin and upper layer that can be formed of a synthetic leather. The heat-sensitive adhesive layer is activated for securing the cushioning pads 22, 122 to the main element 14, 114.

A person skilled in the art will appreciate that, for a reinforced attachment between the cushioning pads 22, 122 and the main element 14, 114, both techniques (heat activated adhesive and stitching lines) can be combined.

Instead of being continuous heat/pressure-formed depression lines, the perimeter section 28, 128 surrounding the cushioning pads 22, 122, the border section 34, 134 surrounding the aeration apertures 32, 132, and/or the moisture escape channels 140 can be obtained with stitching lines inserted simultaneously in the cushioning pads 22, 122 and the main element 14, 114. Therefore, the thickness of each cushioning pad is materially reduced in the perimeter section 28, 128, the border section 34, 134, and/or the moisture escape channels 140. Thus, the edges of each cushioning pad 22, 122 blends smoothly into the fabric material that forms the palm 12, 112 of the athletic glove 10, 110.

Although the material of the main element 14, 114 of the hand glove 10, 110 is shown as being 100% mesh perforated flexible sheet material, the perforated mesh sheet material could alternately be limited to a central palm area 24, 124 or within the apertures 32, 132, while the remaining glove flexible sheet material peripherally of the cushioning pads 22, 122 could be made from non perforated sheet material. Therefore, the main element 14, 114 can be a combination of different materials.

Figure 5:
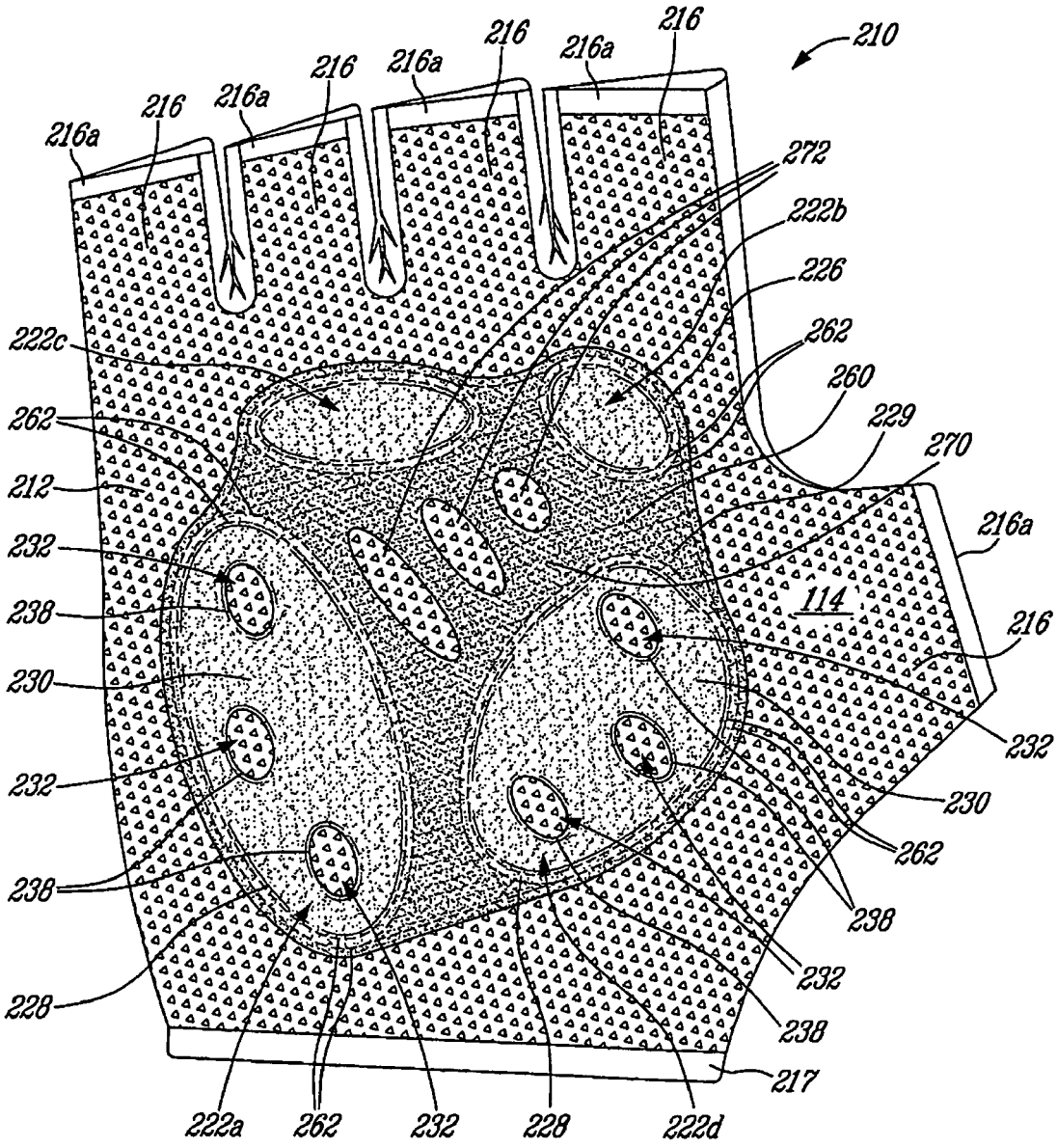
FIG. 5 a top plan view of a cycling hand glove in accordance with another embodiment of the invention, the cycling hand glove including a central palm member with cushioning pads having aeration apertures therein.

Referring to FIG. 5, it will be seen another embodiment of the glove 10, 110 wherein the features are numbered with reference numerals in the 200 series which correspond to the reference numerals of the previous embodiments.

The glove 210 shown in FIG. 5 includes a central pad member 260 having an outer layer 229 mounted to the palm section 212 with stitching lines 226. The central pad member 260 includes four spaced-apart cushioning pads 222*a*, 222*b*, 222*c*, 222*d* located proximate to the perimeter of the central pad member 260. Once again, the cushioning pads 222 are strategically-located in the palm section 212.

The cushioning pads 222*a*, 222*d* have a perimeter 228 defined by stitching lines 262, a cushioning section 230 with inner edges 238 defining individual and spaced apart central aeration apertures 232 exposing the main element 214 of the hand glove 210. As for the aeration apertures 32, 132 of the above-described embodiments, the aeration apertures 232 provide a fluid communication between the user's palm under the cushioning pads 222*a*, 222*d* and the exterior of the glove 210.

On the opposite of the glove 10, 110 shown in FIGS. 1 and 2, the edges 238 of the upper layer 229 are stitched to the main element 214 to create the aeration apertures 232. Therefore, no distinct border section is provided around the aeration apertures 232 as for the gloves 10, 110 described above.

In the embodiment shown in FIG. 5, the central pad member 260 has a central section 270, thinner than the cushioning pads 222. The central section 270 also includes aeration apertures 272 therein exposing the main element 214, for an improved ventilation. However, a person skilled in the art will appreciate that the central pad member 260 can be provided without the aeration apertures 272 or that the aeration apertures 272 can be provided differently.

Figure 6:
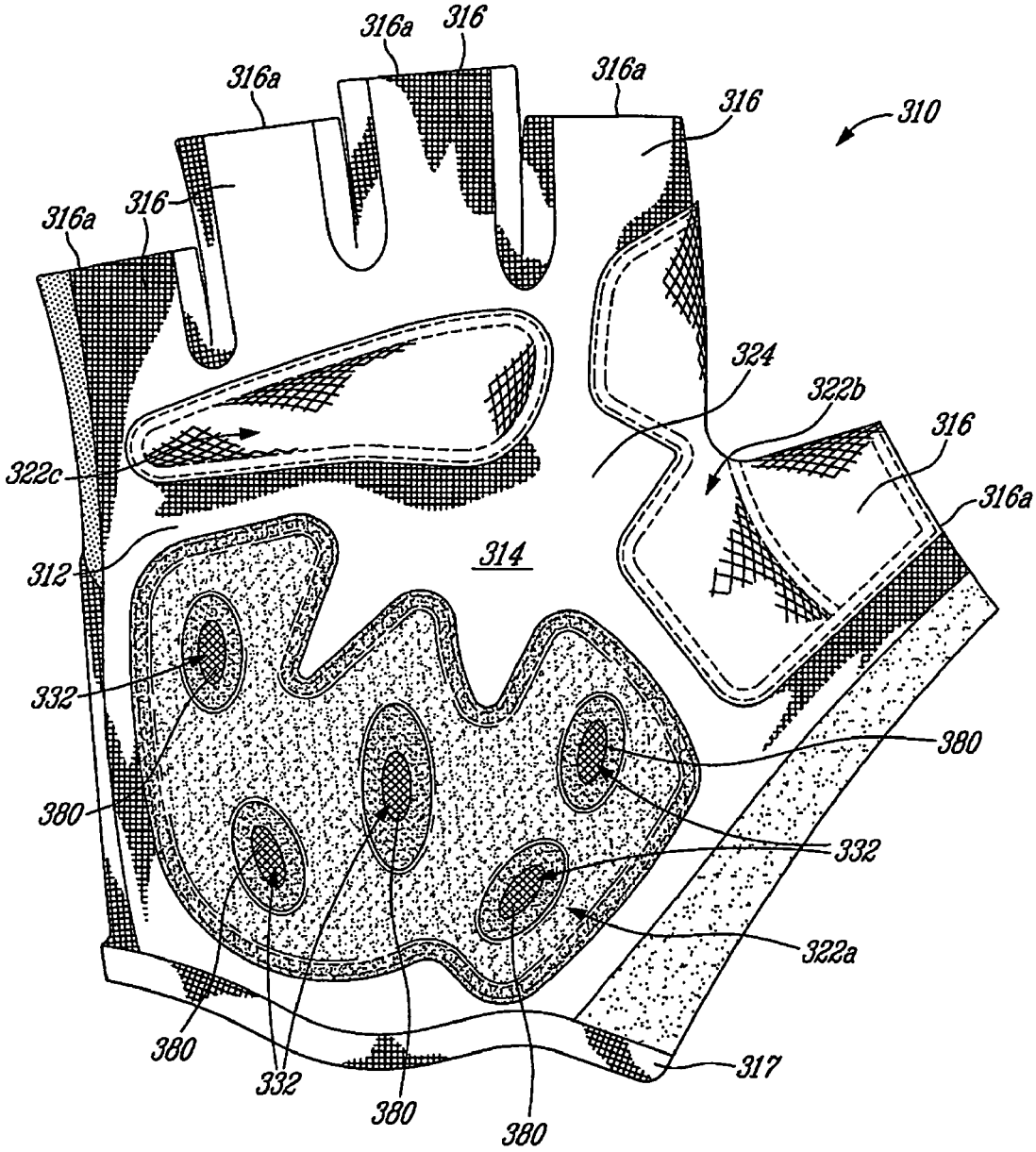
FIG. 6 is a top plan view of the cycling hand glove shown in FIG. 1, wherein the mesh material of the main element has been replaced by a conventional fabric which is perforation-free.

Referring to FIG. 6, it will be seen another embodiment of the glove 10, 110, 210 wherein the features are numbered with reference numerals in the 300 series which correspond to the reference numerals of the previous embodiments.

The glove 310 has the same cushioning pad design than the gloves 10, 110 described above. However, the main element 314 is made from a combination of different material wherein the central palm area 324 is made from a conventional fabric which is perforation-free. The aeration apertures 332 provided in the cushioning pad 322*a* expose a piece of mesh material 380 having perforations therein for an increase air and moisture exchange between the user's palm and the exterior of the glove 310 through the cushioning pad 322*a*.

A person skilled in the art will appreciate that the aeration apertures 332 can also expose the conventional fabric used as the main element 314 or any other fabric.

A person skilled in the art will also appreciate that the upper cushioning pads 22*b*, 22*c*, 122*b*, 122*c*, 222*b*, 222*c*, 322*b*, 322*c* can also include aeration apertures for an increased ventilation of the glove 10, 110, 210, 310.

A person skilled in the art will appreciate that the main element 14, 114, 214, 314 can be formed from any relatively thin and flexible fabric or combination of fabrics and can include small diameter holes that provide ventilation to the hand of a cyclist. For example, synthetic leather that includes a pattern of small diameter through holes that provide ventilation to a user's hand can be used.

The surface represented by the aeration apertures 32, 132, 232, 332 can represent up to 60% of the surface of the cushioning pads 22*a*, 122*a*, 222*a*, 222*d*, 322*a*. More preferably, the surface of the aeration apertures 32, 132, 232, 332 ranges between 10 and 40% of the cushioning pads 22*a*, 122*a*, 222*a*, 222*d*, 322*a* and still more preferably between 20 and 35%.

The size, or diameter, of the aeration apertures 32, 132, 232, 332 of the cushioning pads 22*a*, 122*a*, 222*a*, 222*d*, 322*a* can vary between 1 and 20 mm, more preferably their size can range between 2 and 15 mm, and still more preferably between 3 and 12 mm. For example, the size of ellipsoidal aeration apertures 32, 132, 232, 332 could be 3 mm×12 mm, 5 mm×10 mm, 3 mm×12 mm, etc.

It will also be understood that the finger portions 16, 116, 216, 316 of the hand glove 10, 110, 210, 310 can be cut anywhere along the length of cyclist's fingers. While cycling hand gloves 10, 110, 210, 310 are shown as having short fingers, a person skilled in the art will appreciate that the cycling hand glove can be long finger gloves, including hand gloves that are constructed and arranged for use in winter temperatures.

In other embodiments (not shown), the cushioning pads 22, 122, 222, 322 can include thin, heat/pressure formed, depression lines or fold creases that lie internal of the cushioning sections 30, 130, 230, 330, and that travel across the area of the cushioning sections 30, 130, 230, 330, so as to divide each cushioning section 30, 130, 230, 330 into a number of relatively thick areas that are joined or outlined by the thin depression lines; i.e., each relatively thick cushioning pad 22, 122, 222, 322 is embossed by operation of the thin depression lines that traverse the cushioning section 30, 130, 230, 330 of the cushioning pad 22, 122, 222, 322. The term "diameter" is intended to mean the length of a straight line through the center of an object, which is not necessarily a circle.

While the embodiments described above making reference to the cycling hand glove 10, 110, 210, 310 wherein the cushioning pads 32, 132, 232, 332 are located on the palm side 12, 112, 212, 312 of the hand glove 10, 110, 210, 310, one skilled in the art will appreciate that for another athletic activity which requires hand gloves with cushioning pads 22, 122, 222, 322, the cushioning pads 22, 122, 222, 322 can be located on the back side of the athletic glove 10, 110, 210, 310, or on both the back side and the palm side 12, 112, 212, 312 of the athletic glove 10, 110, 210, 310.

Cycling gloves 10, 110, 210, 310 having cushioning pads 22, 122, 222, 322 in accordance with the invention aid a cyclist in gripping the handlebar B of a bicycle, as the glove cushioning pads 22, 122, 222, 322 support, protect, dampen and absorb shock, and pad the cyclist's hands, and as the glove palm pads 22, 122, 222, 322 minimize the occurrence of numbness of the hands of a cyclist. Moreover, since at least one of the cushioning pads 22, 122, 222, 322 is provided with aeration apertures 32, 132, 232, 332, the comfort of the cyclist is improved.

The hand glove 10, 110, 210, 310 including the aeration apertures 32, 132, 232, 332 within the cushioning pads 22*a*,

122*a*, 222*a*, 222*d*, 322*a* provides an improved dynamic palm hand cooling, in particular when the cyclist is in motion over his bicycle; faster drying of the hand glove 10, 110, 210, 310, if wet from perspiration borne moisture; constant escape of perspiration borne moisture from the hand palm area under the cushioning pad 22*a*, 122*a*, 222*a*, 222*d*, 322*a*; constant cooling fresh air intake availability; and improved overall breathability of the hand glove 10, 110, 210, 310.

The embodiments of the invention described above are intended to be exemplary only. Obviously, the number, size and shape of the cushion pads and of the moisture release apertures or air channels can vary in still other alternate cycling gloves, without restricting the scope of the present invention. Other gloves can be envisioned, not illustrated in the drawings. The scope of the invention is therefore intended to be limited solely by the scope of the appended claims.

What is claimed is:

1. A cycling hand glove comprising:

a main glove element having perforation units defined therein and including a palm surface; and a palm pad provided on the palm surface, extending above a section of the main glove element, and having an outer layer and a padding layer extending between the outer layer and the main glove element, the palm pad having at least one uncovered aeration aperture therein exposing at least one of the perforation units of the main glove element and the hand of the cyclist inserted into the hand glove and extending continuously through the padding layer and the outer layer, a recessed border uniquely surrounding each of the at least one uncovered aeration aperture, the recessed border being formed of a compressed portion of the padding layer and a corresponding portion of the outer layer abutting the compressed portion, and a cushioning section being formed of an uncompressed portion of the padding layer that surrounds the recessed border, the outer layer matching the shape of the padding layer in the palm pad.

2. A cycling hand glove as claimed in claim 1, wherein the at least one aeration aperture exposes a section of the main glove element and the exposed section of the main glove element comprises mesh material with perforations therein.

3. A cycling hand glove as claimed in claim 1, wherein the at least one aeration aperture is defined by an inner edge of the palm pad with a closed figure shape.

4. A cycling hand glove as claimed in claim 1, wherein the cushioning section has a thickness ranging between 1 and 13 millimeters.

5. A cycling hand glove as claimed in claim 1, wherein the at least one aeration aperture comprises a plurality of aperture and the aeration apertures represent up to 50% of the surface of the palm pad including the aeration apertures.

6. A cycling hand glove as claimed in claim 1, wherein the at least one aeration aperture comprises a plurality of aperture and the aeration apertures represent between 10 and 40% of the surface of the palm pad including the aeration apertures.

7. A cycling hand glove as claimed in claim 1, wherein the diameter of the at least one aeration aperture ranges between 1 and 20 millimeters.

8. A cycling hand glove as claimed in claim 1, wherein the palm pad comprises at least one recessed moisture escape channel extending therein between at least one of the at least one aeration aperture and the exterior of the palm pad.

9. The cycling hand glove as claimed in claim 1 wherein the recessed border is thermoformed within a cushioning pad extending across the cushioning section and the recessed border.

10. A method to manufacture an athletic glove, the method comprising:

mounting a cushioning pad having a cushioning section over a main body of the athletic glove, the cushioning pad including an outer layer and a padding layer extending between the outer layer and the main body, the padding layer having a thickness t1 in the cushioning section;

thermoforming at least one recess section within the cushioning pad by applying heat and line pressure to the cushioning pad, the padding layer of the cushioning pad having a thickness t2, in the at least one recess section, thinner than the thickness t1 of the cushioning pad in the cushioning section, the padding layer defining at least one depression and at least one protuberance in the outer layer; and providing at least one perforation through the at least one recess section of the cushioning pad and the outer layer so as to expose the main body of the athletic glove when the cushioning pad is mounted thereto, the at least one perforation being uncovered by the outer layer.

11. A method as claimed in claim 10, comprising cutting the at least one perforation in the cushioning pad.

12. A method as claimed in claim 10, providing a recessed moisture exchange channel in the cushioning pad, the recessed moisture exchange channel extending between the at least one recess section and the exterior of the cushioning pad.

13. A method as claimed in claim 12, comprising thermoforming the moisture exchange channel by applying heat and line pressure on the cushioning pad between the at least one recess section and the perimeter of the cushioning pad.

14. An athletic glove comprising a glove body having a palm portion comprising an upper section and a lower section, the upper section being adjacent to fingers and the lower section being adjacent to a wrist when the glove is worn by a user, the palm portion having a mesh material having perforation units defined therein, and a cushion pad mounted to the mesh material of the palm portion, the cushion pad having an outer layer and a cushion extending between the outer layer and the mesh material, the cushion pad having at least one recess section uniquely surrounded by a cushioning section of the cushion pad, the recess section including a portion of the cushion in a compressed state and a corresponding portion of the outer layer abutting the compressed portion of the cushion, and the cushioning section including an uncompressed portion of the cushion, and an uncovered aeration aperture defined through the at least one recess section, extending continuously through the cushion and the outer layer, and exposing the perforation units of the mesh material, the outer layer corresponding in shape to the padding layer in the cushion pad.

15. The athletic glove of claim 14 wherein the at least one recess section is thermoformed within the cushion pad.

16. The athletic glove of claim 14 further comprising at least one recess channel defined within the cushion pad and interconnecting the at least one recess section with a perimeter of the cushion pad.

17. The athletic glove of claim 16 wherein the at least one recess channel is thermo formed within the cushion pad.

18. The athletic glove of claim 14 wherein the cushion is sandwiched between an outer polymer film and an inner polymer film.

19. The athletic glove of claim 14 wherein the cushion pad is mounted to the glove body by stitching.

20. The athletic glove of claim 14 wherein the cushion pad is in the lower section of the palm portion.

21. An athletic glove comprising:

a main glove element, having perforation units defined therein, including a palm surface including an upper section, a lower section, and a central palm section extending between the lower and the upper sections, the upper section being adjacent to fingers and the lower section being adjacent to a wrist when the glove is worn by a user;

a lower section cushion pad mounted to the main glove element in the lower section; and an upper section cushion pad mounted to the main glove element in the upper section, the central palm section being cushion pad free, the lower and upper section cushion pads having an outer layer and a padding layer extending between the outer layer and the main glove element, at least one of the lower and upper section cushion pads having at least one recess section surrounded by a cushioning section of the cushion pad, the recess section including a portion of the padding layer in a compressed state and a corresponding portion of the outer layer abutting the compressed portion of the padding layer, and the cushioning section including an uncompressed portion of the padding layer, and an uncovered aeration aperture uniquely defined through the at least one recess section, extending continuously through the cushion and the outer layer, and exposing at least one of the perforation units of the main glove element and a hand inserted into the glove, the padding layer defining at least one depression and at least one protuberance in the outer layer.

22. The athletic glove of claim 21 wherein the at least one recess section is thermoformed within the at least one cushion pad including the aeration aperture.

23. The athletic glove of claim 21 further comprising at least one recess channel defined within the at least one cushion pad including the aeration aperture and interconnecting the at least one recess section with a perimeter of the cushion pad.

24. The athletic glove of claim 23 wherein the at least one recess channel is thermoformed within the at least one cushion pad including the aeration aperture.

25. A glove, comprising:

a glove material including a palm surface having air and moisture permeable perforations defined therein; and a cushioning pad, attached to the palm surface and being formed of an outer layer and a padding layer interposed between the outer layer and the palm surface, the cushioning pad including pads, in which the padding layer is uncompressed, and perimeter forming and at least one moisture escape channel recesses, in which the padding layer is compressed, wherein:

an area of the pads is delimited by the perimeter forming recess and the at least one moisture escape channel recess, which is disposed within the perimeter, and each moisture escape channel recess is formed to define at least one aeration aperture within a region of which the air and moisture permeable perforations are uncovered by any component of the cushioning pad.

26. The glove according to claim 25, wherein the recesses are thinner than the pads.

27. The glove according to claim 25, wherein each moisture escape channel recess communicates with the perimeter forming recess.

* * * * *